United States Patent [19]

Pick

[11] Patent Number: 5,059,218

[45] Date of Patent: Oct. 22, 1991

[54] CONSTRUCTION FOR SUPPORTING A FLEXIBLE SHEET

[76] Inventor: William Pick, Highway 15, R.R. #1, Carleton Place, Ontario, Canada, K7C 3P1

[21] Appl. No.: 442,508

[22] Filed: Nov. 28, 1989

[51] Int. Cl.[5] ..... A44B 21/00; B03C 3/09; B03C 3/86

[52] U.S. Cl. ..... 55/131; 55/145; 55/493; 55/511; 55/DIG. 31; 160/371; 160/380; 160/381; 160/395

[58] Field of Search ..... 55/124, 126, 131, 155, 55/490, 493, 509, 511, DIG. 31, 140, 145; 160/371, 380, 381, 395, 397

[56] References Cited

U.S. PATENT DOCUMENTS

| | | | |
|---|---|---|---|
| 890,398 | 6/1908 | Baker | 160/381 |
| 1,171,952 | 2/1916 | Higgin | 55/DIG. 31 |
| 1,496,594 | 6/1924 | Otto | 160/371 |
| 2,784,781 | 3/1957 | Rhoades | 160/371 |
| 3,438,180 | 4/1969 | Klouda | 55/124 |
| 3,509,696 | 5/1970 | Thompson | 55/131 |
| 4,007,024 | 2/1977 | Sallee et al. | 55/131 |
| 4,153,981 | 5/1979 | Stuppy | 160/395 |
| 4,195,681 | 4/1980 | Douglas et al. | 160/371 |
| 4,410,027 | 10/1983 | Lucous | 160/380 |
| 4,467,504 | 8/1984 | Quist | 160/395 |
| 4,549,887 | 10/1985 | Joannou | 55/131 |
| 4,662,038 | 5/1987 | Walker | 160/395 |
| 4,828,586 | 5/1989 | Joannou | 55/131 |

*Primary Examiner*—Jay H. Woo
*Assistant Examiner*—James P. Mackey
*Attorney, Agent, or Firm*—Foley & Lardner

[57] ABSTRACT

A construction for supporting a flexible sheet is disclosed which includes a U-shaped channel having opposing flanges that are adapted to receive a complimentary spline member for frictionally engaging a flexible sheet, such as window screen, between a surface of the spline member and an adjacent inner surface of one flange of the U-shaped channel. The structure has several practical applications including the construction of window screens, electrostatic air filters of the charged media type, storm windows of plastic film and the like. An improved construction for an electrostatic air filter of the charged media type is also disclosed.

17 Claims, 7 Drawing Sheets

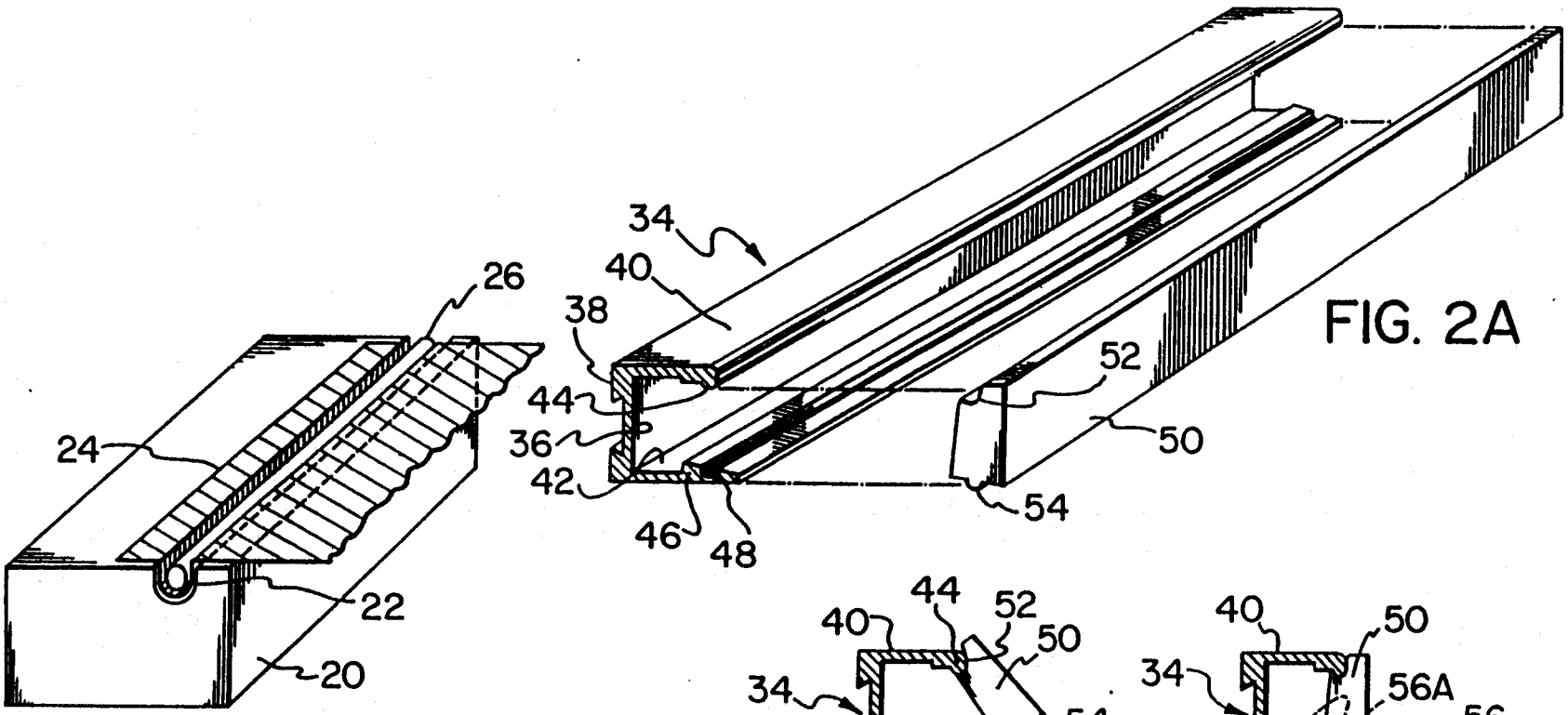
FIG. 2A
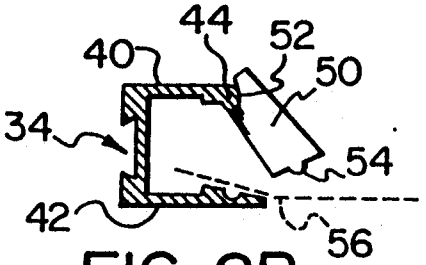
FIG. 2B
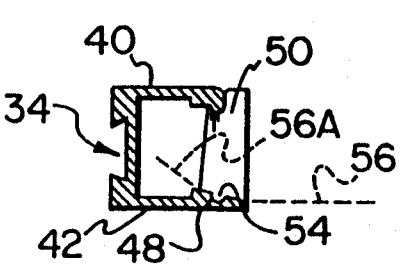
FIG. 2C
FIG. 1
PRIOR ART

CONSTRUCTION FOR SUPPORTING A FLEXIBLE SHEET

The present invention relates to a construction for supporting a flexible screen or sheet such as window screen, or the like, and its application to the assembly of an electrostatic air filter of the charged media type.

BACKGROUND OF THE INVENTION

Flexible screen or sheets such as window screen, plastic films and the like used for various applications including the closing and covering of window openings are well known in the art. Flexible screens or sheets are usually mounted in a frame which is attached to the structure of a window opening. A common material for assembling such frames is an aluminum roll formed section, which is generally an elongated box shaped structure provided with a U-shaped spline groove adjacent an edge of one surface. Four lengths of a roll formed section are commonly assembled into a frame using corner brackets or other fasteners known in the art. A flexible sheet such as window screening is attached to the frame by cutting the sheet to the approximate size of the frame, laying the sheet over that side of the frame which is provided with the spline groove and forcing the sheet into the spline groove with a flexible spline member sized to frictionally engage the sheet with the walls of the spline groove. This is a difficult task which requires a certain amount of skill and experience to install the sheet with even tension and without wrinkling the sheet or warping the frames. In addition, after attaching a flexible sheet to a frame with a conventional spline member, the selvage edges of the sheet must be trimmed to provide a neat appearance and prevent the accidental removal of the sheet from the spline groove by catching the exposed loose edges of the sheet. Trimming the exposed loose edges of the sheet is a tedious and labour intensive task which contributes significantly to the cost of attaching a flexible sheet to a frame.

An alternate method of attaching a flexible sheet to a frame is disclosed in Canadian Patent 1,108,476, which issued on Sept. 8, 1981. This patent describes a fastener for attaching a specially constructed flexible sheet to a frame. The specially constructed flexible sheet is provided along its opposing edges with a permanently attached metallic or plastic extrusion that is gripped by a D-shaped metal fastener. The disadvantage of this method is that the flexible sheet must be precisely dimensioned to the size of the frame opening in order to achieve an acceptable fit, and attaching the required clips is a lengthy and relatively delicate process which is, in itself, time consuming.

SUMMARY OF THE INVENTION

It is an object of the present invention to overcome the disadvantages of the prior art described above.

It is a further object of the invention to provide constructions for attaching a flexible sheet to a frame which are simpler, faster and easier to use than known prior art methods.

It is yet a further object of the invention to provide an improved electrostatic air filter assembly of the charged media type which includes a flexible sheet supported by the construction in accordance with the invention.

Accordingly, an improved spline member has been invented which includes a protruding spline and has a tapered flanges which extend laterally from the top of the spline. If a flexible sheet is properly sized as to marginally overlap the spline groove of a frame, the sheet can be installed without trimming the loose edges of the sheet after attachment to a roll formed section frame using the improved spline member described above.

Also provided is a construction for supporting a flexible sheet, which construction includes a U-shaped channel and a spline member cooperative with the free ends of the flanges of the channel. Preferably, one flange of the U-shaped channel is slightly shorter than the other. The shorter flange is further preferably provided with a rounded nose along the inner edge of its free end. The longer flange is preferably provided with a wedge-shaped region on the inner surface of its free end, which region includes a longitudinal groove that is parallel with the free end of the flange. The spline member is preferably shaped to pivot on the rounded nose of the shorter flange and further preferably includes a ridge cooperative with the groove in the longer flange for frictionally engaging a sheet between the spline member and the inclined wedge of the longer flange. This construction has many advantages over traditional frames for supporting a flexible sheet. Since the channel conceals the free edges of the sheet, no trimming of the sheet is required after installation. The structure of the spline permits it to be quickly snapped into place without danger of tearing, creasing or deforming the sheet being installed. This eliminates the tedious process of installing a prior art spline in a groove. Finally, as a result of the cooperation of the mating surfaces between the longer flange and the spline member, the sheet is tensioned evenly on installation, eliminating wrinkles, waves and sag in the installed sheet.

Besides being perfectly adapted to the construction of window screens and the like, the construction in accordance with the invention is also adapted to be used for the assembly of a novel electrostatic air filter of the charged media type. The construction eliminates many of the traditional problems and time consuming aspects of an electrostatic air filter assembly. For use in the assembly of an electrostatic air filter, the channel members are modified by the inclusion of a dove-tailed groove on the back surface of each channel. The dove-tailed groove permits the installation of various plastic clips, hinges and connectors so that an electrostatic air filter of the charged media type may be clipped together in a fraction of the time required for assembling the same style of filter using traditional assembly techniques.

In more general terms, there is provided a spline member for frictionally engaging a flexible sheet in a spline groove, comprising:

A member having a spline region cooperative with said spline groove and a tapered lip regions which extends laterally from the top of said spline region, said tapered lip serving to cover the selvage edge of a flexible sheet secured in a spline groove by said spline member.

There is further provided a construction for supporting a flexible sheet, comprising:

a channel having two opposing spaced apart flanges;

a spline member removably engageable between the free end regions of said flanges for frictionally engaging an edge region of said flexible sheet between an inner surface of one said flange and an adjacent surface of said spline member;

the adjacent surfaces of said spline member and said flanges cooperating so that the movement of said spline and said flexible sheet relative to said channel is inhibited.

Further provided is an electrostatic air filter of the charged media type comprising:

first and second opposing frames assembled from channels adapted to receive a spline member between the free edges of their opposing flanges;

electrically conductive flexible charging media attached to one side of each said frame by frictional engagement of said media between said spline members and adjacent flange surfaces;

hinge members interconnecting said frames to form a hollow box structure;

a pair of fibrous filter pads disposed within said hollow box structure in opposed parallel adjacent relationship;

an inner charging medium disposed between said fibrous filter pads; and a high voltage power source having its negative pole in electrical connection with one said frame and its positive pole in electrical connection with said inner charging medium.

BRIEF DESCRIPTION OF THE DRAWINGS

The present invention will now be explained by way of example only and with reference to the following drawings wherein:

FIG. 1 is a cross-sectional view of a prior art roll formed section used in the assembly of frames for supporting flexible sheets such as window screening;

FIG. 2 is a cross-sectional view of a roll formed section and a flexible sheet attached thereto by an improved spline member disclosed herein;

FIG. 5*a* is a cross-sectional view of the structural components of an electrostatic air filter of the charged media type assembled using the construction in accordance with the invention, the air filter being in a closed condition;

FIG. 5*b* is a cross-sectional view of the air filter shown in FIG. 5*a,* the air filter being in an open condition;

FIG. 11 a is a perspective view of two filters interconnected in an opposed parallel relationship;

FIG. 11*b* is a detailed cross-sectional view of the connection of two or more filters in the relationship illustrated in FIG. 11*a.*

DETAILED DESCRIPTION OF THE PREFERRED EMBODIMENT

Figures 3A, 3B, 3C:
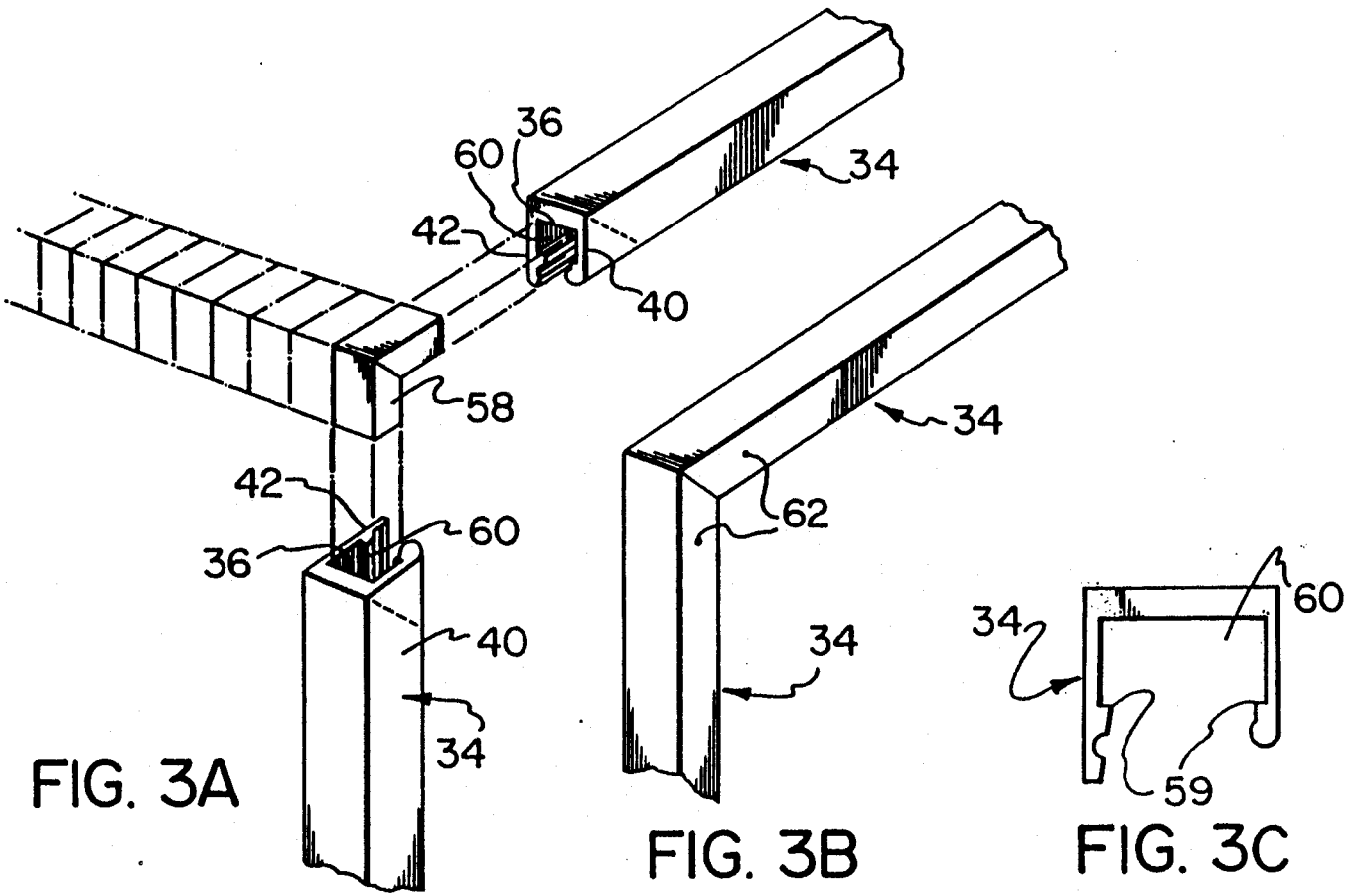
FIG. 3*a* is a perspective view of a spline and channel construction for supporting a flexible sheet in accordance with the invention.
FIG. 3*b* is a cross-sectional view of the spline and channel construction of FIG. 3*a* showing the construction in an open condition.
FIG. 3*c* is a cross-sectional view of the spline and channel construction of FIG. 3*a* showing the construction in a closed condition.

As shown in FIG. 1, prior art frames for supporting flexible sheets such as insect screening for windows or doors frequently comprise a roll formed section 20 provided with a spline groove 22 which is continuous along an edge of the roll formed section. A flexible sheet 24, such as insect screening, is affixed to the roll formed section 20 with a flexible spline 26. Flexible sheet 24 is attached to the roll formed section 20 by placing a precut sheet over the frame and forcing the flexible spline 26 and the flexible sheet 24 simultaneously into the spline groove 22, thereby frictionally engaging the flexible sheet 24 in the spline groove between the spline 26 and the walls of the groove 22. A selvage edge must be allowed along the outer edges of sheet 24 for a successful installation and that selvage edge must be trimmed off after the spline 26 is installed in order to provide a neat appearance. The installation of spline member 26 and the required trimming of the selvage edge is, of course, a labour intensive and time consuming process which has apparently never been successfully automated.

As shown in FIG. 2, an improved spline member has been invented to obviate the requirement of trimming the selvage edges of a flexible sheet after its installation on a frame having a spline groove. The spline member generally indicated by reference 28 includes a spline region 30 having a laterally projecting tapered lip region 32 for covering the selvage edge of flexible sheet 24. The improved spline 28 therefore eliminates the time consuming process of trimming the selvage edges from a flexible sheet installed on a frame having a spline groove.

FIG. 3A illustrates a novel construction in accordance with the invention for supporting a flexible sheet. The construction includes a channel which is preferably extruded and is generally indicated by reference 34. The channel 34 includes a web 36, a back 38 and a pair of flanges 40 and 42. Flange 40 is preferably shorter than flange 42 and preferably includes a rounded nose 44 which extends along the entire length of its lower outer free edge. The lower flange 42 is preferably longer than flange 40 and includes a wedge shaped region 46 which is upwardly inclined from the outer edge of flange 42. Wedge-shaped region 46 further includes a longitudinal groove 48 which is parallel with the edge of channel 42 and is preferably centered in wedge-shaped region 46. The channel 34 may be extruded from any material having suitable structural properties, however, aluminum is preferred.

The second component of the construction is an elongated spline 50 which is preferably extruded in long sections and subsequently cut to the lengths required. Spline 50 includes a rounded groove 52 on its upper inside corner and a longitudinal ridge 54 which extends along the center of its angled bottom face. The spline 50 may be extruded from any extrudable material, however, dense plastics such as polyvinylchloride are preferred.

As seen in FIG. 3B, the rounded groove 52 in spline 50 cooperates with rounded nose 44 on flange 40 to provide a pivot surface for the spline 50. As is apparent in FIG. 3B, the lower edge of spline 50 is angled upwardly from its outer corner. This permits spline 50 to be pivoted inwardly from the position illustrated in FIG. 3B without the inner corner striking the outer edge of flange 42 and interfering with the swivel motion. As is apparent from FIG. 3C, when spline 50 is swivelled inwardly, the longitudinal ridge 54 cooperates with longitudinal groove 48 to lock flexible sheet 56, window screen, for example, or any other flexible sheet, between the spline 50 and flange 42. As is apparent, any selvage edge 56A of flexible sheet 56 is concealed within channel 34 and does not require trimming or other treatment. In addition, the rotation of spline 50 across the wedge-shaped region 46 of flange 42 evenly tensions flexible sheet 56. This tends to eliminate any ripples or sags in the flexible sheet 56 and provides a neat installation. Thus a frequently encountered problem of properly and evenly tensioning a flexible sheet when attaching it to a prior art roll formed section is obviated.

Figures 4A, 4B:
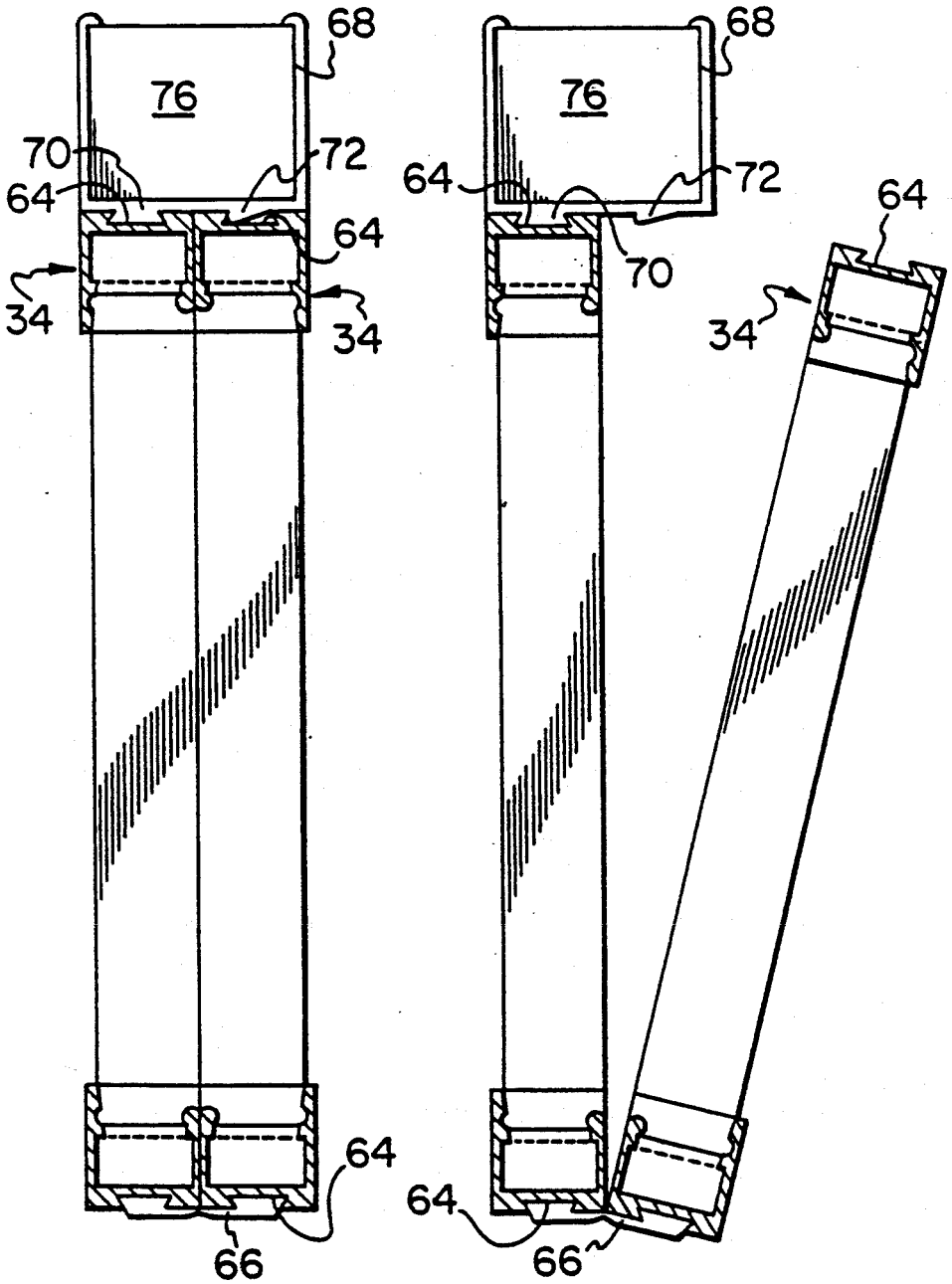
FIG. 4*a* is a perspective view of a recommended corner assembly for use with the spline and channel construction in accordance with the invention.
FIG. 4*b* is a perspective view of the assembled corner shown in FIG. 4*a;*

FIG. 4A illustrates a preferred corner connector for the construction shown in FIG. 3A–3C. The corner connector includes an extruded corner 58, preferably nylon or polyvinyl chloride, though many other materials, including aluminum, are equally suitable. The corner connector is preferably extruded in long sections which are subsequently cut into lengths appropriate for fitting snugly into a square socket 60 formed by the web 36 and the inner surfaces of flanges 40 and 42. The mating ends of each channel 34 are preferably mitered at 45° to produce a smooth finished corner as illustrated in FIG. 4B. Each channel 34 may for example be punched at points 62 to deform the channel against the extruded corner 58 and thereby inhibit separation of the finished corner. Glue or other bonds between the corner connector and the channels may also be used.

FIGS. 5A and 5B illustrate a novel electrostatic air filter, the supporting framework of which air filter is assembled using the construction in accordance with the invention. Channels 34 are modified to include a dove-tailed groove 64 on their back when used in the assembly of the electrostatic air filter schematically illustrated in cross-section in FIGS. 5A and 5B. As is apparent, two rectangular frames constructed in accordance with the invention are hinged together along their one edges by a plastic hinge 66 and latched together along their opposing edges by a channel extrusion 68. Channel extrusion 68 is preferably a plastic extrusion having some flexibility. One side of the bottom surface of channel 68 is provided with a longitudinal dove-tailed protrusion 70 which locks the channel extrusion 68 to the dove-tailed groove 64 in one channel 34. On the opposite side of the bottom surface of channel extrusion 68 is provided a wedge-shaped latch 72 which serves to lock the opposing frames together. As may be seen in FIG. 5B, the electrostatic air filter frame may be opened and closed using the wedge-shaped latch 72 provided on the channel extrusion 68.

Figures 5, 6:
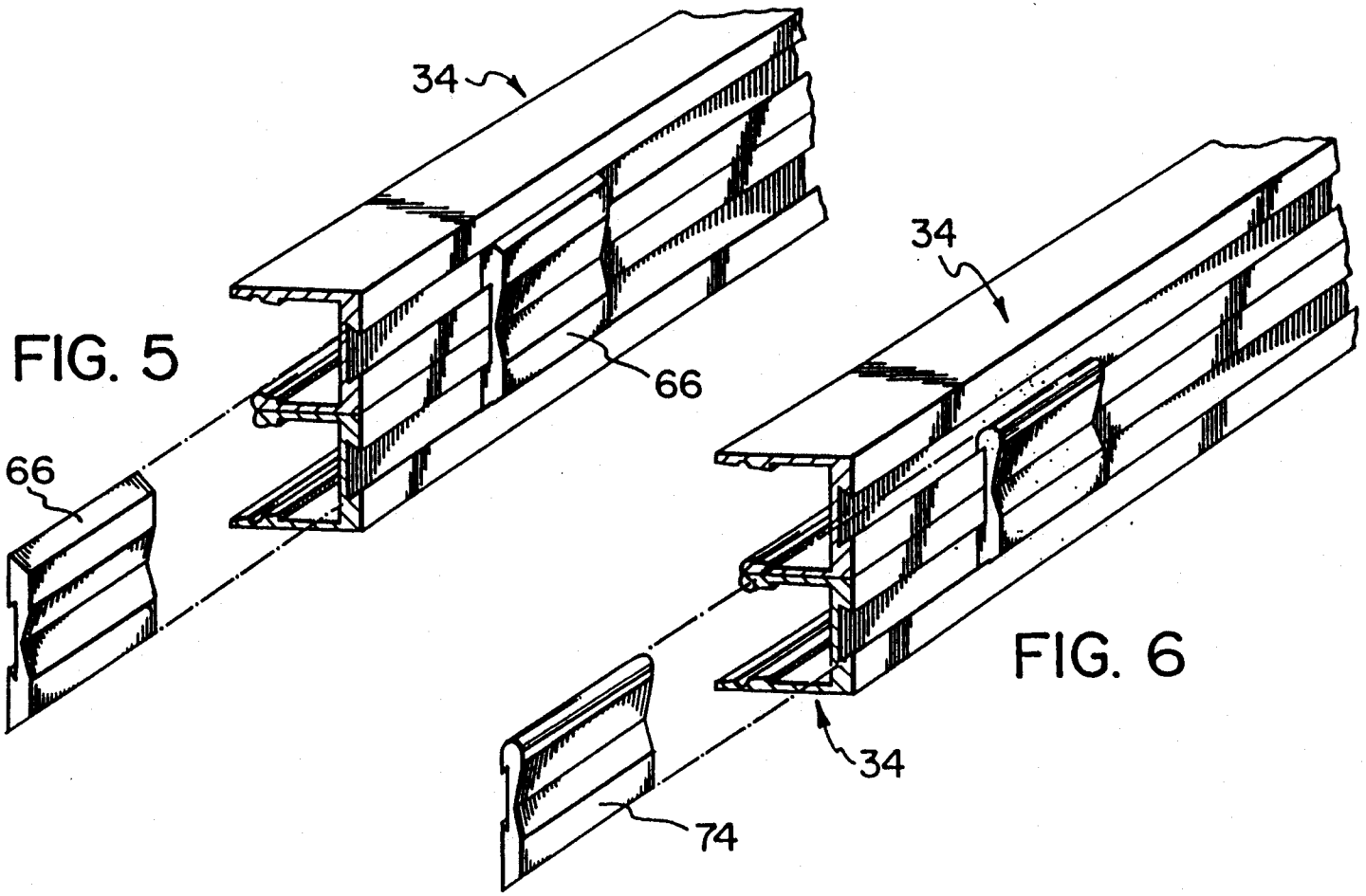
FIG. 6 is a detailed view of the hinge construction shown in cross-section in FIGS. 5*a* and 5*b;*

FIG. 6 illustrates in detail the plastic hinge shown in cross-section in FIGS. 5A and 5B. The hinge is preferably extruded in long sections and subsequently cut into lengths suitable for use as hinges. The hinges may be extruded from any thermoplastic having good resistance to flex fatigue, polyethylene, for example.

Figure 7:
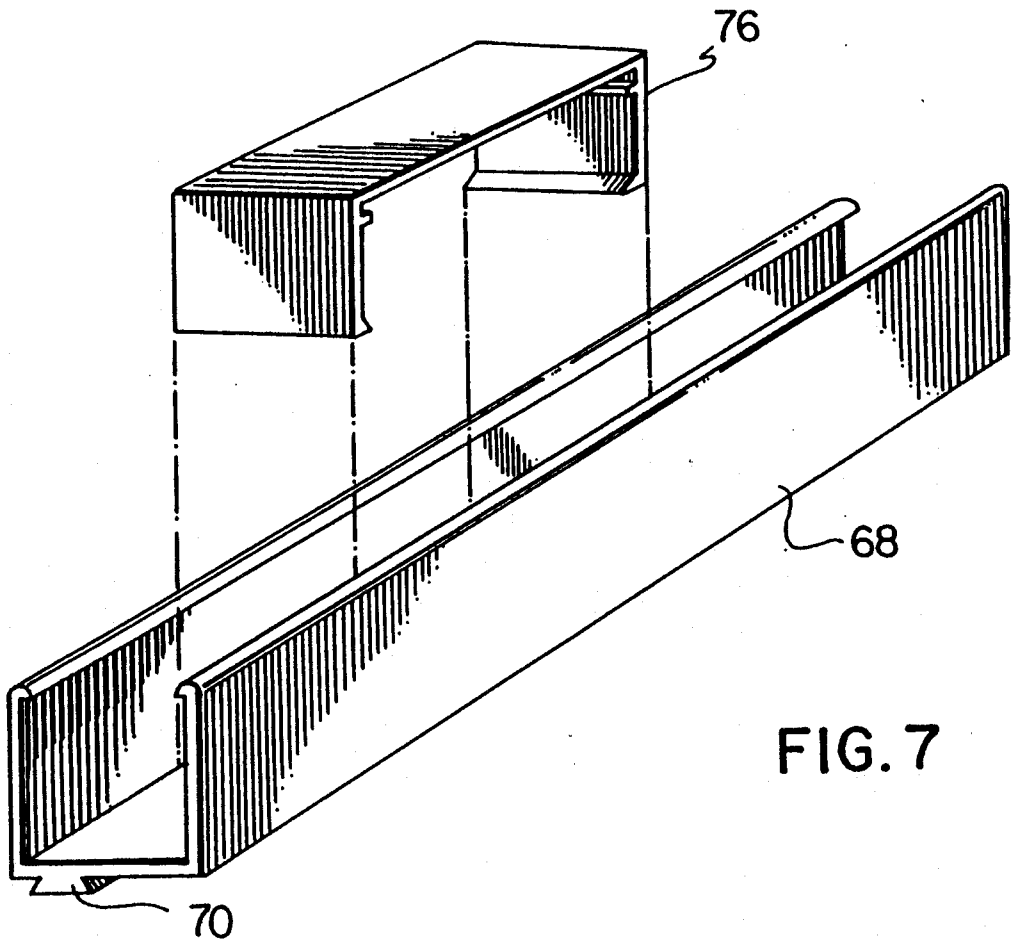
FIG. 7 is a detailed view of a clasp closure suitable for use with the electrostatic air filter construction shown in FIGS. 5*a* and 5*b;*

FIG. 7 illustrates an extruded latch 74 for frames 34. Extruded latch 74 is preferably extruded in long sections similar to extruded hinge 66 and subsequently cut into suitable lengths. Thus the latch 72 may be eliminated on the bottom surface of extruded channel 68 and the frames may be locked together on one or both ends using an extruded latch as illustrated in perspective and cross-sectional views in FIG. 7. This permits channel 68 to be extruded from rigid materials such as aluminum.

Figure 8:
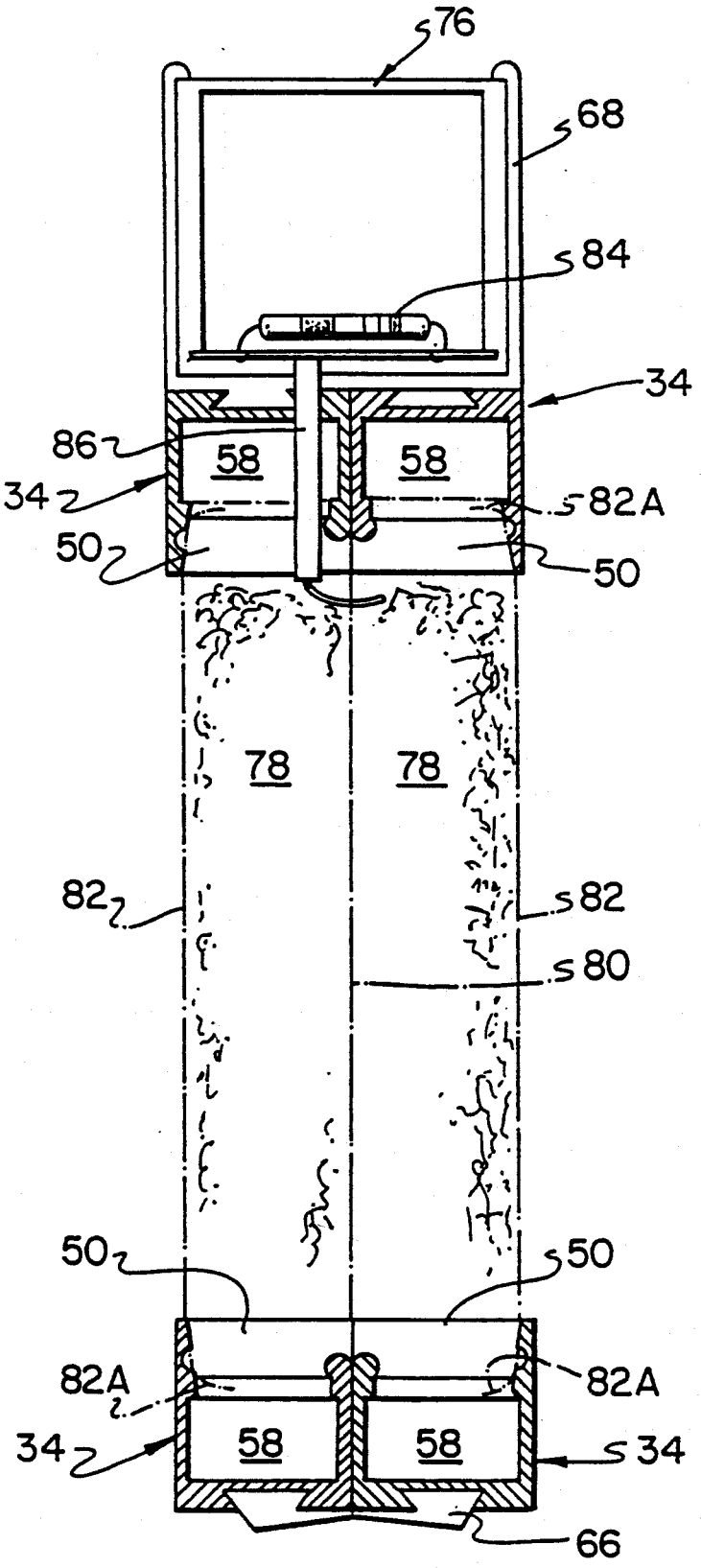
FIG. 8 is a detailed perspective view of a channel for housing the high voltage power supply of the electrostatic air filter shown in FIGS. 5*a* and 5*b;*

FIG. 8 is a detailed perspective view of extruded channel 68 and an extruded electronics housing 76. The electronics housing 76 is designed to support the high voltage power supply used to power the electrostatic air filter. The electronic housing 76 snaps into channel 68 as will be explained in more detail hereinafter. The electronic housing 76 is likewise preferably extruded in long sections and cut into appropriate lengths after extrusion. It may be formed from any extrudable material, but is preferably extruded from a thermoplastic.

Figure 9A:
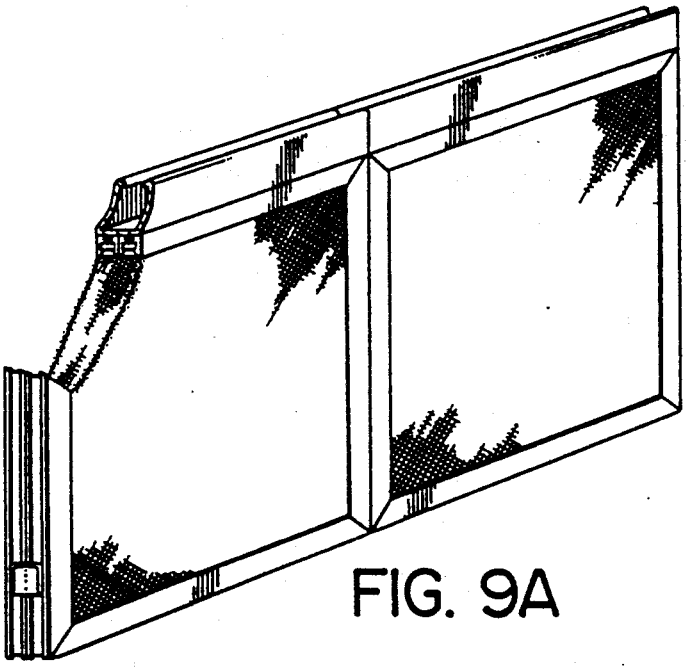
FIG. 9 is a cross-sectional view of a completely assembled electrostatic air filter of the charged media type as shown in FIGS. 5*a* and 5*b;*
Figure 9B:
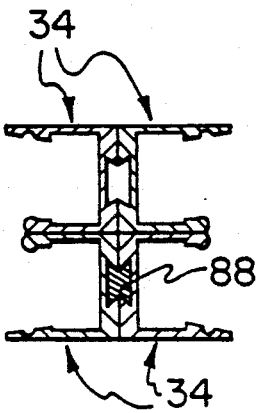

FIG. 9 shows a cross-sectional view of a fully assembled electrostatic air filter in accordance with one aspect of the invention. As is apparent, channels 34 are assembled into a pair of opposing rectangular frames which are hinged together by flexible plastic hinges 66. A charging medium 82 is attached to the outer side of each frame using splines 50 as explained above. Charging medium 82 is preferably an electrically conductive woven wire screen or an electrically conductive expanded metallic mesh. Sandwiched between the opposing charging media 82 are a pair of dielectric fibrous filter pads 78 and a third electrically conductive charging medium 80. Charging medium 80 is in turn connected to the positive pole of the high voltage power supply, generally indicated by reference 84, by an insulated high voltage electrode 86. Charging medium 80 may be any conductive material, including a carbon-filled odour absorbing charging medium.

An electrostatic air filter of the charged media type as illustrated in FIG. 9 is assembled in the following manner. Firstly, the opposing frames of the air filter are assembled with channels 34 using extruded corners 58 (see FIG. 4). Charging media 82 are then connected to the frames by snapping in spline members 50 to tension the charging media and retain them firmly within the frames. Hinge members 66 are slid into place in the dove-tail grooves on the bottom side of the filter and the extruded channel 68 is attached to the top of one frame member. A hole is subsequently drilled through the channel 68 and the top of channel 34 for the passage of high voltage electrode 86. The high voltage power supply 84 is clipped into electronics housing 76 and the housing is snapped into extruded channel 68 while guiding the high voltage electrode 86 through the hole provided. A ground connection (not illustrated) must be supplied for electrically interconnecting one of frame members 34 with the ground pole of the high voltage power supply. It should be noted that the dielectric filter pads 78 and the center charging media 80 may be cut in unison. Prior art filter constructions of the charged media type, required that the center charging medium be cut separately from the filter pads as it had to be smaller in length and width than the filter pads so as to not to contact the outer sides of the air filter frame and thereby cause electrical arching and loss of charge. This filter construction also eliminates any need for trimming the selvage edges 82a of outside charging media 82. It is therefore apparent that an electrostatic air filter of the charged media type may be thus assembled in a fraction of the time required for the assembly of prior art air filters of the same style.

Figure 10A:
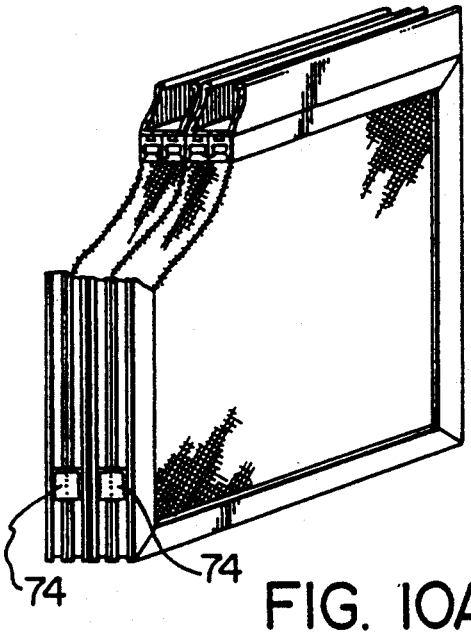
FIG. 10*a* is an illustration of the assembly of two or more of the filters shown in FIG. 9 in an end to end relationship.
Figure 10B:
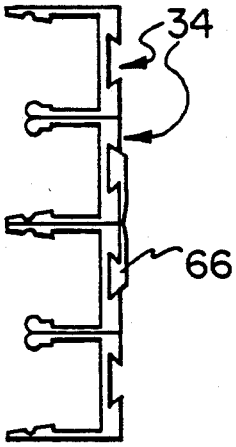
FIG. 10*b* is a detailed cross-sectional view of the connectors used for linking the filters shown in FIG. 10*a;*

FIG. 10A shows how two or more of the air filters illustrated in FIG. 9 may be connected in an end-to-end relationship to form a gang of filters to provide increased air filter area in an air handling system. As seen in FIG. 10B, the filters are interconnected in an end-to-end relationship with dove-tail shaped connectors 88, preferably plastic extrusions.

FIG. 11A illustrates an alternate connection of filters into a bank of parallel filters to enhance the removal of filtrates from filtered air. In this case, the filters are interconnected using either plastic hinges 66 or, preferably, extruded latches 74. Any number of filters may be connected side to side in this manner, however, resistance to airflow through the filters increases with each filter added.

In use, the electrostatic air filter in accordance with one aspect of the invention is assembled as shown in FIG. 9 and installed in an air handling system. When power is connected to the high voltage power supply 84, the center screen 80 is charged with high voltage power on the order of 6 to 10 kilovolts. Thus an electrostatic field is created between charging media 80 and 82 to polarize the fibers in the dielectric filter pads 78. Particle contaminants in the air forced through the filter are attracted to the polarized fibers in the dielectric filter pad 78 and thereby removed from the filtered air. Electrostatic air filters of this type are known to greatly increase the efficiency of the filter media in removing particulates from filtered air.

Changes and modifications in the specifically described embodiments can be carried out without departing from the scope of the invention which is intended to be limited only by the scope of the appended claims.

I claim:

1. A construction for supporting a flexible sheet comprising:

a channel of generally U-shaped cross-section, which channel includes a web and first and second parallel spaced-apart flanges, each flange having a longitudinal free edge which is remote from the web of the channel;

the first flange being shorter than the second flange, the free edge of the second flange extending beyond the free edge of the first flange;

the first flange including a protruding nose region extending longitudinally from an inner face of the free edge thereof;

the second flange including an inclined ramp region which extends longitudinally from an inner face of the free edge, the ramp region being wedge-shaped and tapered from a thin edge adjacent the free edge of the second flange;

a spline member adapted for removable engagement between free edge regions of the first and second flanges to frictionally engage an edge region of the flexible sheet between the ramp region of the second flange and a complementarily inclined surface of the spline member; and means for securing the spline member within the channel when the spline member is engaged between the free edge regions of the first and second flanges of the channel.

2. A construction for supporting a flexible sheet as recited in claim 1 wherein the spline member comprises:

an elongated member of generally rectangular cross-section, having a top edge, a bottom edge and front and rear faces;

the top edge including a longitudinally extending groove adjacent the rear face for pivotal cooperation with the protruding nose region of the free edge of the first flange;

the bottom edge having a substantially planar surface which is upwardly inclined with respect to the front face so that said bottom edge contacts the ramp region on the free edge of the second flange to frictionally engage the flexible sheet therebetween; and means for inhibiting the movement of the spline member relative to the channel when the spline member is engaged between the first and second flanges of the channel.

3. A construction for supporting a flexible sheet, as recited in claim 2, wherein the means for inhibiting the movement of the spline member relative to the channel when the spline member is engaged between the free edge regions of the first and second flanges of the channel, comprises:

a longitudinal groove in the wedge-shaped ramp region along an inner face of the free edge of the second flange; and a longitudinal ridge, complementary with said longitudinal groove in the ramp region, located on the bottom edge of the spline member, so that the ridge engages the groove in the ramp region to inhibit the movement of the spline member relative to the channel when the spline member is pivoted into engagement between the free edge regions of the first and second flanges of the channel.

4. A construction for supporting a flexible sheet, as recited in claim 1, wherein a square step in an inner surface of each flange adjacent the web of the channel, in combination with the web of the channel, substantially defines a rectangular chamber for receiving one complementary end of a two-ended corner connector for interconnecting two discrete lengths of the channel at a predetermined angle, whereby at least four discrete lengths of the channel are interconnected with the corner connectors to construct a frame for supporting a flexible sheet.

5. A construction for supporting a flexible sheet comprising:

a channel of generally U-shaped cross-section which includes a web and first and second opposed, parallel, spaced-apart flanges, each said flange having a longitudinally extending free edge remote from the web of the channel;

the first flange being shorter than the second flange and the channel being constructed so that the free edge of the second flange extends beyond the free edge of the first flange;

the first flange including a protruding rounded nose region along an inner side of the free edge thereof;

the second flange including an inclined ramp region along an inner side of the free edge thereof, the ramp region being wedge-shaped and tapered from a thin edge adjacent the free edge of the second flange and including a shallow groove parallel with, and spaced inwardly from the free edge of the second flange, so that the groove is substantially opposite the rounded nose region of the first flange; and a spline member for removable engagement between free edge regions of the first and second flanges to frictionally engage an edge region of the flexible sheet between the ramp region of the second flange and a complementary surface of the spline member, the spline member being an elongated member of substantially rectangular cross-section having a top edge, a bottom edge and opposed front and rear faces, the top edge including a longitudinal groove adjacent the rear face for cooperation with the protruding nose region along the inner side of the free edge of the first flange, and the bottom edge including a substantially planar surface which inclines upwardly with respect to the front face of the spline member so that it is complementary to the ramp region of the free edge of the second flange and further includes a longitudinal rounded ridge complementary with the shallow groove in the ramp region of the second flange for engaging the shallow groove and inhibiting the relative movement of the spline member with respect to the second flange.

6. A construction for an electrostatic air filter of the charged media type, comprising:

first and second opposed rectangular frames respectively assembled from channels of generally U-shaped cross-section which include a web, a back and first and second parallel spaced-apart flanges, each said flange having a longitudinal free edge remote from the web of the channel, the first flange being shorter than the second flange and the channel being constructed so that the free edge of the second flange extends beyond the free edge of the first flange; and the channel receives a spline member between the free edges of the first and second flanges thereof, the spline member cooperating with the free edges of the first and second flanges to affix an electrically conductive flexible charging medium to one side of each said frame by frictional engagement of said charging medium between the spline member and an inclined ramp region on an inner surface of the free edge of the second flange, the spline member and the second flange further including means for inhibiting the movement of the spline member with respect to the channel when the spline member is engaged between the free edges of the first and second flanges;

hinge members for interconnecting said frames to provide a hollow box structure;

a pair of fibrous filter pads disposed within said hollow box structure in opposed, parallel, adjacent relationship;

an inner charging medium disposed between said fibrous filter pads; and a high voltage power source having its negative pole in electrical connection with one said frame and its positive pole in electrical connection with said inner charging medium.

7. A construction for an electrostatic air filter of the charged media type as recited in claim 6 wherein the first flange includes a rounded nose region which extends longitudinally along an inner surface of the free edge thereof.

8. A construction for an electrostatic air filter of the charged media type, as recited in claim 7, wherein the spline member is an elongated substantially rectangular member with a top edge, a bottom edge and opposed front and rear faces, the top edge including a longitudinal groove adjacent the rear face for cooperation with the rounded nose region of the first flange.

9. A construction for an electrostatic air filter of the charged media type as in claim 6, wherein the means for inhibiting the movement of the spline member with respect to the channel includes a longitudinal groove in the inclined ramp region of the inner surface of the free edge of the second flange and a complementary longitudinal ridge on a bottom edge of the spline member, whereby the ridge on the spline member engages the groove in the ramp region of the second flange when the spline member is engaged between the free edges of the first and second flanges of said channels.

10. A construction for an electrostatic air filter of the charged media type, as recited in claim 6, wherein each channel includes a dovetail groove which extends longitudinally the length of the backs of said channels.

11. A construction for an electrostatic air filter of the charged media type as recited in claim 10, wherein the hinge members each comprise a plastic extrusion having dovetail-shaped connectors on each side of a flexible hinge region for engaging the dovetail grooves in the backs of the channels of the first and second frames.

12. A construction for an electrostatic air filter of the charged media type as in claim 10 wherein the opposed rectangular frames are releasably clipped together by clasps which each comprise a plastic extrusion having a dovetail-shaped connector on one side of a flexible hinge region and a hook-shaped connector on an opposite side of the flexible hinge region, the dovetail-shaped connector being complementary with the dovetail groove in the back of a channel in the first frame and the hook-shaped connector releasably engaging an edge of the dovetail groove in the back of an opposite channel of the second frame.

13. A construction for an electrostatic air filter of the charged media type as recited in claim 10 wherein the high voltage power source is housed in an extruded channel having a back, a web and first and second opposed parallel flanges connected to the web, said extruded channel further including a dovetail-shaped connector don a side of the back thereof for engaging the dovetail groove in the back of a channel of one of the first and second frames of the air filter.

14. A construction for an electrostatic air filter of the charged media type as recited in claim 13 wherein the extruded channel which houses the power source is extruded from a flexible plastic.

15. A construction for an electrostatic air filter of the charged media type as recited in claim 14 wherein the back of the extruded channel further includes a clip opposite the dovetail-shaped connector for releasably engaging the dovetail groove in an opposite channel of the other of the first and second frames of the air filter.

16. A fastener for supporting a flexible sheet along an edge thereof, comprising:

a channel for receiving and containing the edge of the flexible sheet, the channel being defined by two opposing spaced apart flanges and a web therebetween, a free edge of one flange having a nose extending along the length of said one flange and an inner surface of the other flange having a free edge and a groove along the length of said other flange, the inner surface of said other flange being inclined;

a spline pivotally engageable between the free edges of said flanges for frictionally engaging the spline only between the nose of the one flange and the inner surface of the other flange, a first longitudinal edge of the spline including a groove for pivotal engagement with the nose of said one flange and an opposite edge of the spline having an incline complementary to the inclined inner surface of said other flange for permitting pivotal engagement between the spline and the channel; and the flexible sheet being received between the inclined inner surface of the other flange and the complementary edge of the spline.

17. An electrostatic air filter of the charged media type, comprising:

first and second frames for positioning in a stream of air, the frames being in opposing relationship to each other, each frame supporting thereon an electrically conductive, flexible sheet, the frames assembled from channel which include a first and second parallel spaced-apart flange and a connecting web, each said flange having a free edge remote from the web, the first flange including a protruding rounded nose along an inner surface of the free edge thereof, and the second flange including an inclined ramp region along an inner surface of the free edge thereof, the ramp region being wedge-shaped with a thin edge adjacent the free edge of the second flange and including a groove which is parallel with and spaced inwardly from the free edge of the second flange; and a spline member for removable engagement between the rounded nose of the first flange and the ramp region of the second flange to frictionally engage an edge of the flexible sheet between the ramp region of the second flange and a complementary surface of the spline member, the spline member having a substantially rectangular cross-section with a top edge, a bottom edge and opposed front and rear faces, the top edge including a longitudinal groove adjacent the rear face for cooperation with the nose of the first flange, the bottom edge being complementary with the ramp region of the second flange and including a ridge for engaging the groove in the ramp region to inhibit the relative movement of the spline member with respect to the second flange;

hinge members interconnecting said frames to form a hollow, openable and closable box structure;

a pair of fibrous filter pads disposed within said hollow box structure in opposing parallel adjacent relationship;

an inner charging medium disposed between said fibrous filter pads; and a high voltage power source having one pole in electrical connection with said frames and its other pole in electrical connection with said inner charging medium.

* * * * *